US009567761B1

(12) United States Patent
Corio et al.

(10) Patent No.: US 9,567,761 B1
(45) Date of Patent: Feb. 14, 2017

(54) CUTTING FENCE WITH HANDLE

(71) Applicants: Samuel D. Corio, Little Egg Harbor, NJ (US); John J. Corio, Little Egg Harbor, NJ (US)

(72) Inventors: Samuel D. Corio, Little Egg Harbor, NJ (US); John J. Corio, Little Egg Harbor, NJ (US)

( * ) Notice: Subject to any disclaimer, the term of this patent is extended or adjusted under 35 U.S.C. 154(b) by 39 days.

(21) Appl. No.: 14/506,739

(22) Filed: Oct. 6, 2014

(51) Int. Cl.
*B25B 5/16* (2006.01)
*E04G 21/18* (2006.01)

(52) U.S. Cl.
CPC ..... *E04G 21/1891* (2013.01)

(58) Field of Classification Search
CPC ..... B25B 5/00; B25B 5/067; B25B 5/068; B25B 5/082; B25B 5/102
See application file for complete search history.

(56) References Cited

U.S. PATENT DOCUMENTS

| | | | | |
|---|---|---|---|---|
| 7,114,715 | B1 * | 10/2006 | Kirk | B25B 5/068 269/147 |
| 8,393,063 | B2 * | 3/2013 | Hodges | B25B 5/068 269/128 |
| 8,505,892 | B2 * | 8/2013 | Seidel | B25B 5/003 269/249 |
| 2011/0095463 | A1 * | 4/2011 | Eberle, III | B25B 1/103 269/6 |

* cited by examiner

*Primary Examiner* — Lee D Wilson
(74) *Attorney, Agent, or Firm* — Michael R. Philips

(57) ABSTRACT

The invention provides a cutting fence with handle formed for attachment to a first cut rafter, or other custom shaped board, for building construction or the like. The cutting fence has a fence plate extending downwardly from a first end of a handle and a foot extending downwardly from a second end of the handle. A lip is provided on the fence plate to be coplanar with a horizontal portion of the foot. Holes are formed through the fence plate and the foot to mount the cutting fence to a cut rafter for use as a pattern to mark and cut additional boards to be substantially identical to the first cut rafter.

6 Claims, 3 Drawing Sheets

CUTTING FENCE WITH HANDLE

FIELD OF THE INVENTION

The present invention relates to the field of tools and jigs for building construction, and more particularly such tools and jigs for cutting multiple lumber pieces.

BACKGROUND OF THE INVENTION

In the process of constructing a building, certain lumber pieces are used in full or partial lengths with minimal cutting. Examples are floor joists and wall studs that are frequently used in the length as purchased, e.g. 93 inches for studs or 12 feet for joists. In some cases, such as in positions below or above a window opening, the studs are cut in length to fit the space as required. Other pieces of lumber, such as roof rafters and stair stringers, require angle cutting and/or notching. In order for the roof or stairs to be properly aligned, the first rafter is carefully measured and cut. The first rafter is checked to determine if the angle is proper and the roof will fit as designed, then the first rafter is copied to produce multiple additional rafters that are as close as possible to an exact match.

A process has been known to utilize the first cut rafter as a pattern by attaching one or more fence blocks to a long edge of the first cut rafter by nails or screws. The cut rafter is placed on an uncut rafter board with the fence block or blocks in firm contact with a long edge of the uncut rafter board. With the first cut rafter and the uncut rafter board held together, the cut pattern is either cut directly or scribed on the uncut board, enabling the board to be substantially identical to the first cut rafter. Additional uncut rafter boards are handled and cut in the same manner. This process may be applied to other building construction components requiring intricate cutting, e.g. stair stringers.

The currently used method has drawbacks, including difficulty in maintaining alignment accuracy between the first cut rafter and successive rafter boards and difficulty in lifting and handling the first cut rafter. The invention disclosed below provides a unique device for overcoming the present drawbacks with a reliable and safe cutting fence with handle.

SUMMARY OF THE INVENTION

The present invention provides a cutting fence with handle for use in making multiple identically cut boards. The cutting fence and handle has a fence plate for attachment to a long edge of a first cut rafter with a portion of the fence plate extending beyond the long edge to contact an uncut rafter board. The fence plate has a lip attached at a mid-point to engage a broad side of the first cut rafter. A handle is attached at a first end to the fence plate with a foot attached to the opposite end of the handle, the foot having a horizontal extension that is parallel to the lip. To use the cutting fence with handle, the fence plate is placed against a long edge of the first cut rafter with the lip resting on an adjacent broad side of the cut rafter. The handle extends over a portion of the broad side with the foot horizontal extension resting on the broad side. A nail or screw is used to affix the fence plate to the long edge and a second nail or screw is used to affix the horizontal extension to the broad side with the handle residing parallel to the broad side of the cut rafter. A second cutting fence with handle is preferably mounted to the first cut rafter in a second position to provide two handles for secure holding and lifting the first cut rafter. The cut rafter is placed on an uncut rafter board with the fence plates in contact with a long edge of the uncut rafter board and the pattern of the cut rafter is either cut directly or marked on the uncut rafter board.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENT

Figure 1:
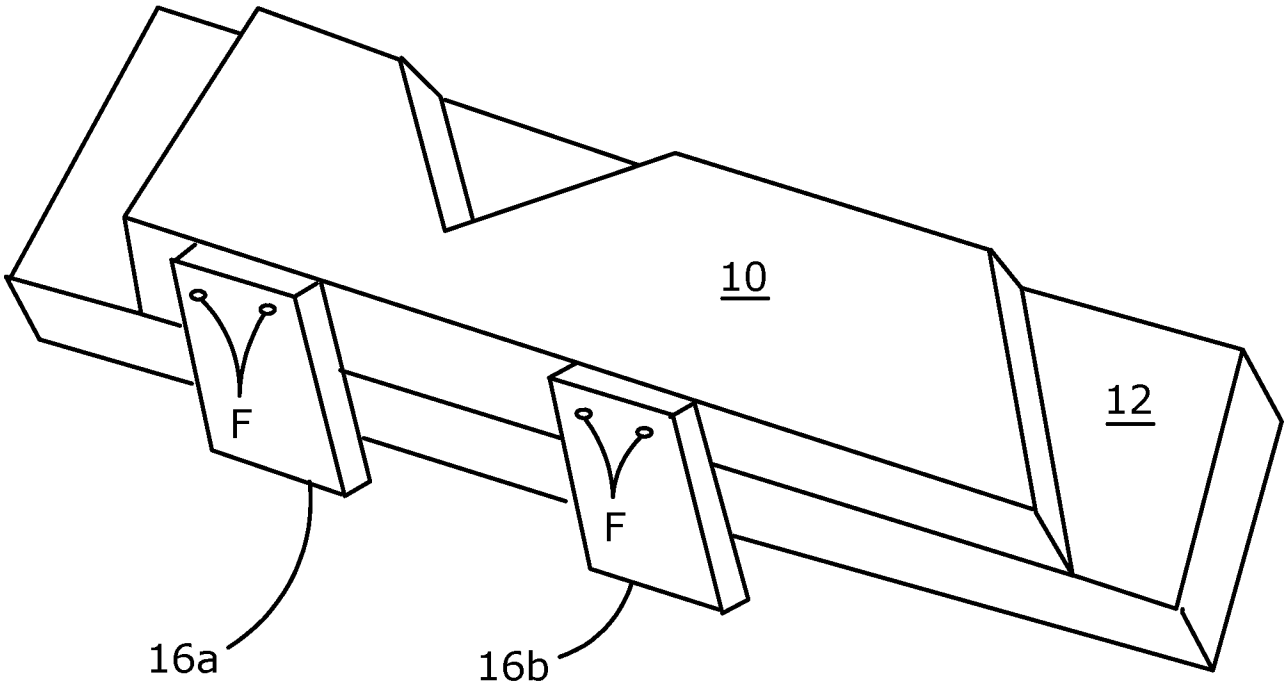
Fig. 1 PRIOR ART
FIG. 1 is a perspective view of a first cut rafter with two wooden fence blocks attached to a long edge thereof according to the prior art, the cut rafter positioned on an uncut rafter board.

Referring to FIG. 1, a first cut rafter 10 is illustrated in perspective view positioned on top of an uncut rafter board 12. Cut rafter 10 and rafter board 12 are formed of construction lumber, e.g. 2 inch thick by 10 inch wide. As is common practice, prior to the condition in which first cut rafter 10 appears, an uncut rafter board was measured and marked, then cut to the form shown. A pair of wood fence blocks 16*a*, 16*b* are mounted to a long edge of cut rafter 10 with fasteners F according to the prior art. Fence blocks 16*a*, 16*b* extend beyond the edge of cut rafter 10 to be pressed against a long edge of uncut rafter board 12 to enable uncut rafter board 12 to be marked or cut to match the shape of first cut rafter 10. First cut rafter board 10 is then lifted and placed on a second rafter board (not shown) to repeat the process. As is apparent, there is no way provided to securely and safely lift and position first cut rafter 10.

Figure 2:
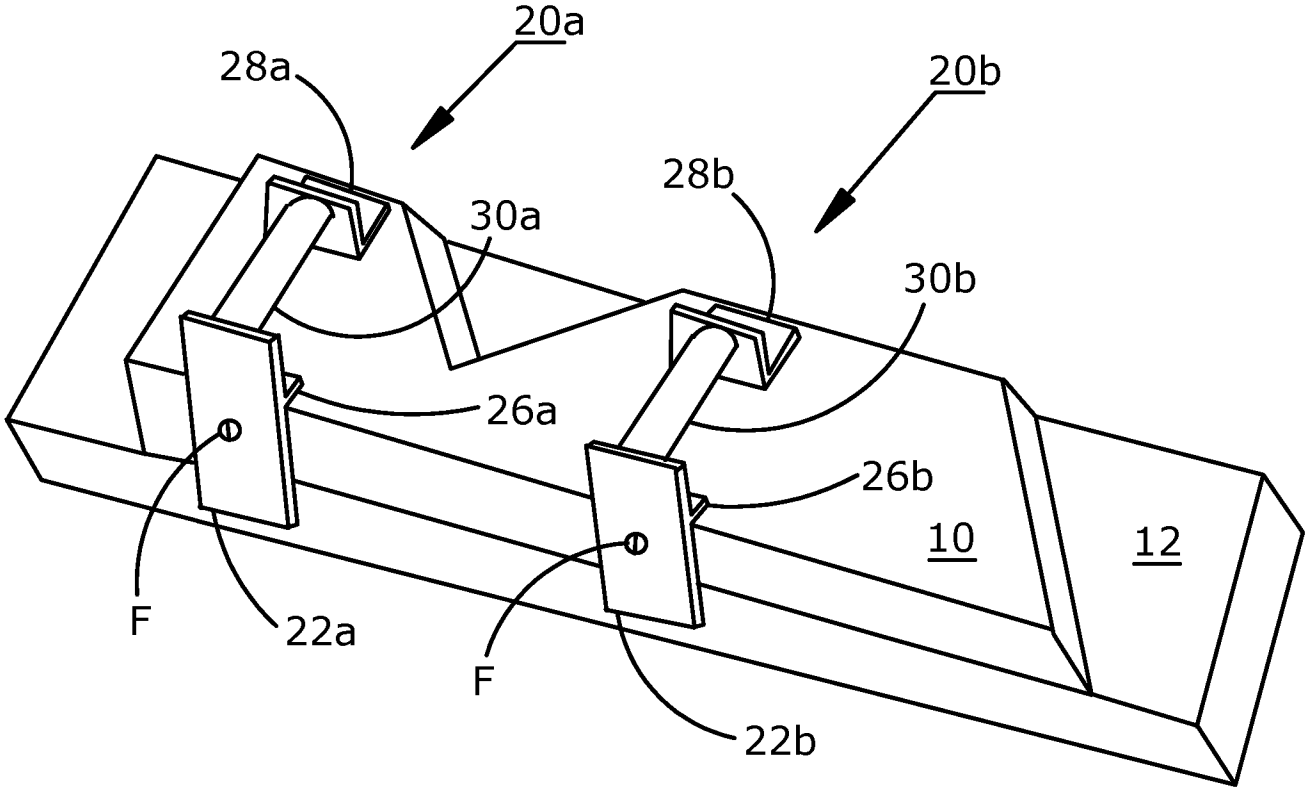
FIG. 2 is a perspective view of a first cut rafter with two cutting fences with handles of the present invention attached to a long edge thereof, the cut rafter positioned on an uncut rafter board.

Referring now to FIG. 2, first cut rafter 10 is illustrated in perspective view positioned on uncut rafter board 12. A pair of cutting fences 20*a*, 20*b* of the present invention are mounted to first cut rafter 10. The following description references first cutting fence with handle 20*a* and applies similarly to second cutting fence with handle 20*b*. A fence plate 22*a* is formed as a planar, substantially rectangular plate. Fence plate 22*a* has a lip 26*a* affixed thereto and extending in orthogonal relation to fence plate 22*a*. A lower portion of fence plate 22*a* overlies a long edge of uncut rafter board 12. A handle 30*a* is affixed to fence plate 22*a* substantially in parallel relation to and a distance above lip 26*a*. A foot 28*a* is affixed to the opposite end of handle 30*a*, foot 28*a* having a vertical portion and a horizontal portion, with the horizontal portion oriented substantially coplanar with lip 26*a*. With lip 26*a* and the horizontal portion of foot 28*a* in contact with the broad side of first cut rafter 10, handle 30*a* resides substantially parallel to the broad side of first cut rafter 10 at a distance separated therefrom. A first fastener F and a second fastener (not visible in this view) attach cutting fence with handle 20*a* to first cut rafter 10.

Figure 4:
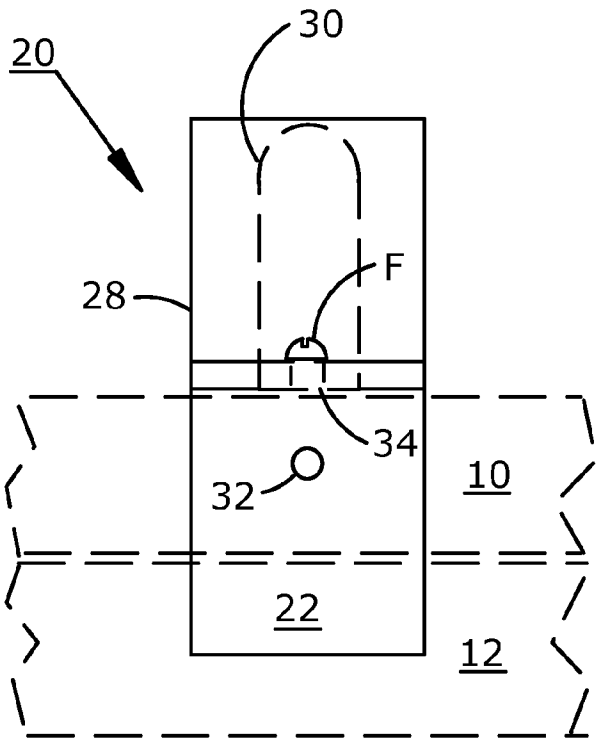
FIG. 4 is an end elevation view of the cutting fence with handle of FIG. 3.
Figure 3:
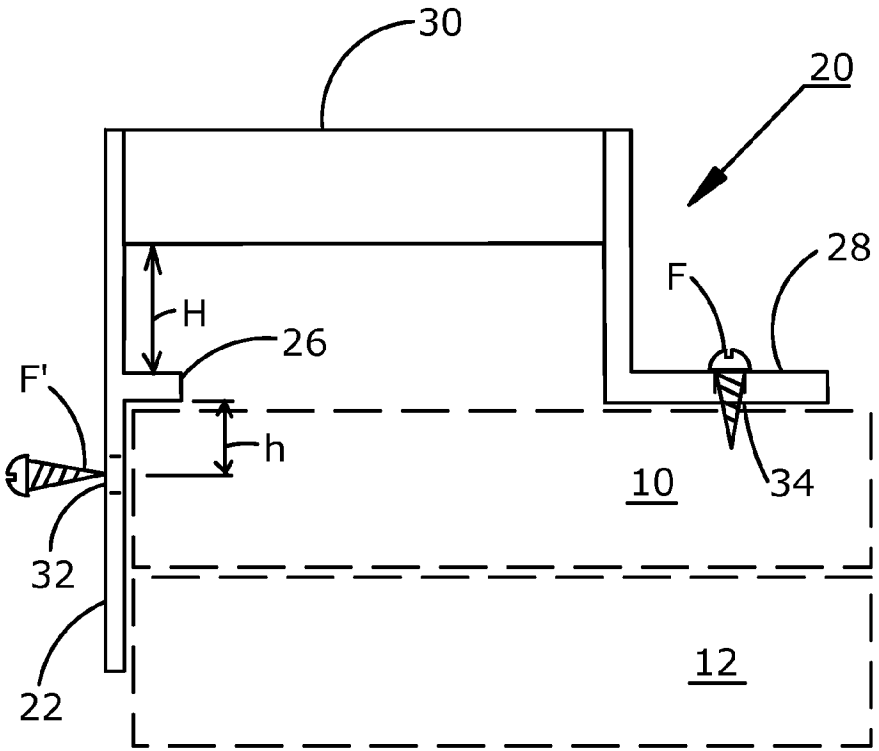
FIG. 3 is a side elevation view of the cutting fence with handle of the invention positioned on a first cut rafter board and an uncut rafter board, the boards shown in dashed lines.

Referring now to FIGS. 3 and 4, cutting fence 20 is shown in side elevation view and end elevation view respectively, as mounted on a first cut rafter 10. Cut rafter 10 is resting on top of uncut rafter board 12. Cut rafter 10 and rafter board 12 are shown in dashed lines for clarity. Fence plate 22 is pressed against a long edge of cut rafter 10 with a portion extending beyond cut rafter 10 to overlie a long edge of uncut rafter board 12. Lip 26 is seen resting on the top surface of cut rafter 10. Handle 30 is affixed at a first end to fence plate 22 and at a second end to foot 28. A first fastener F is installed through hole 34 and a second fastener F' is positioned for installation through hole 32 to anchor cutting fence 20 to cut rafter 10. Handle 30 resides a distance H above lip 26, distance H being on the order of 1.0 inch. Hole 32 is positioned a distance h below lip 26, on the order of ⅝ inch, such that fastener F' will generally enter the central area of cut rafter 10. Whereas foot 28 sits on the side surface of cut rafter 10, it is understood that the present invention is useful for various widths of lumber, e.g. 2×6, 2×8, 2×10, etc.

As described above and delineated in the claims to follow, the cutting fence and handle of the present invention provides a safe, reliable, and secure device for handling cut boards in the process of reproducing a specific shape when multiple boards are needed in the construction of a building or similar purposes.

While the description above discloses a preferred embodiment of the present invention, it is contemplated that numerous variations and modifications of the invention are possible and are considered to be within the scope of the claims that follow.

What is claimed is:

1. A cutting fence with handle, comprising:

a. a substantially planar fence plate;

b. a lip affixed to and extending outward from a surface of the fence plate;

c. a handle having a first end and a second end, the first end affixedly mounted to and extending from the surface of the fence plate and spaced apart from the lip;

d. a foot having a vertical portion and a horizontal portion, the vertical portion affixed to the second end of the handle and the horizontal portion residing coplanar with the lip; and e. means for removably mounting the fence plate and the foot horizontal portion to a first horizontally oriented board;

f. whereas a portion of the fence plate extends below the lip and the foot by a distance sufficient to overlie a thickness of the first horizontally oriented board and a portion of a second horizontally oriented board residing below the first board.

2. The cutting fence with handle described in claim 1, wherein the means for removably mounting the fence plate and the foot horizontal portion to a board comprise a fastener passing through a first hole formed through the fence plate and a fastener passing through a second hole formed through the foot horizontal portion.

3. The cutting fence with handle described in claim 2, wherein the handle is affixed to the fence plate on a first side of the lip and the hole through the fence plate is formed on a second side of the lip.

4. A cutting fence with handle, comprising:

a. a substantially planar fence plate;

b. a substantially planar lip affixed to and extending perpendicularly outward from a surface of the fence plate;

c. a handle having a first end and a second end, the first end affixedly mounted to and extending perpendicularly outward from the surface of the fence plate and spaced a distance from the lip;

d. a foot having a first portion residing parallel to the fence plate and a second portion that is coplanar with the lip, the first portion affixedly mounted to the second end of the handle;

e. means for removably mounting the fence plate to a first board; and f. means for removably mounting the second portion of the foot to the first board;

g. whereas a portion of the fence plate extends beyond the lip by a distance sufficient to overlie a thickness of the first board and a portion of a second board.

5. The cutting fence with handle described in claim 4, wherein the means for removably mounting the fence plate and the means for removably mounting the second portion of the foot to a board comprise a fastener passing through a hole formed through the fence plate and a fastener passing through a hole formed through the second portion of the foot.

6. The cutting fence with handle described in claim 5, wherein the handle is mounted to the fence plate on a first side of the lip and the hole through the fence plate is formed on a second side of the lip.

* * * * *